United States Patent [19]

Felder

[11] Patent Number: 5,003,518

[45] Date of Patent: Mar. 26, 1991

[54] RUNNING TIME METER FOR ENGINE

[76] Inventor: Randolph E. Felder, 2136 Connie Dr., Denham Springs, La. 70726

[21] Appl. No.: 461,336

[22] Filed: Jan. 5, 1990

[51] Int. Cl.[5] ..... G04F 8/00; G04B 47/00

[52] U.S. Cl. ..... 368/5; 368/8; 368/10; 368/110; 368/113

[58] Field of Search ..... 368/1, 5, 6, 8–10, 368/107–113

[56] References Cited

U.S. PATENT DOCUMENTS

| | | | |
|---|---|---|---|
| 1,785,724 | 12/1930 | Brant . | |
| 1,967,157 | 7/1934 | Thornton-Norris | 161/15 |
| 3,948,039 | 4/1976 | Leveraus | 368/5 |
| 3,965,669 | 6/1976 | Larson et al. | 368/5 |
| 4,290,128 | 9/1981 | Estabrook | 368/1 |
| 4,472,964 | 9/1984 | Kluger | 73/116 |
| 4,624,578 | 11/1986 | Green | 368/10 |

*Primary Examiner*—Vit W. Miska
*Attorney, Agent, or Firm*—David L. Ray

[57] ABSTRACT

A compact and inexpensive meter for measuring and recording the time an engine driven apparatus has been running. The apparatus includes a signal generator such as a piezoelectric transducer which produces an electrical current when the engine driven apparatus is operating, a rectifier for converting the electrical current produced by said signal generator to direct current, a transistor for receiving the electrical current from the rectifier and switching on a stopwatch timing unit when the voltage received from the rectifier reaches a predetermined level.

20 Claims, 1 Drawing Sheet

RUNNING TIME METER FOR ENGINE

BACKGROUND OF THE INVENTION

1. Field of the Invention

The present invention relates to timing devices for recording the time an apparatus has been operating. More particularly, the invention relates to devices for recording the length of time an engine-driven apparatus has been running.

2. Description of the Related Art

Numerous devices are known in the art for measuring the time an electrically powered or engine driven apparatus has been operating. Exemplary of such devices are those disclosed in the following U.S. Patents.

U.S. Pat. No. 4,624,578 discloses a rental contract timer system for use on rental equipment such as television sets. Rental equipment such as television sets are provided with a timer which operates a relay to connect power to the equipment only during the time for which rental has been paid. The timer includes a magnetic reader head and decoder to produce digital signals corresponding with a magnetic strip which has been encoded with the rental period and identifying information at the location where the rent is paid. The timer contains a real-time clock and microprocessor to compare the current time with the time in the rental period. A power supply for the timer derives energy from the same power lines used for the rental equipment, but a battery is also provided to power the clock alone when the power supply is not energized. Displays of the current time and rental expiration time are provided, as well as visible and audible alarms to warn of the approach of the end of the rental period.

U.S. Pat. No. 4,472,964 discloses an apparatus for indicating the need for maintenance work on an internal combustion engine. The device is equipped, in the manner of an electric clock, with a frequency reducer, an amplifier, a stepping motor, and a clock movement. The frequency reducer, however, does not receive its pulses from a quartz oscillator, as in the case of a quartz clock, but from a pulse generator of a revolution indicator. The pulse generator can, of course, also be a separate component which is intended exclusively for the device.

U.S. Pat. No. 4,290,128 discloses a time sequence monitor having a plurality of signal channels, a plurality of stopwatch circuits and a plurality time lapse displays interconnected so that the relative time lapses in a series of related occurences can be displayed.

U.S. Pat. No. 3,965,669 discloses an engine running time indicator for use with an engine. The running time indicator has a ceramic resonator-controlled oscillator that drives an electronic divider, a multiplexer, and a stepping motor which is connected through a gear train to a mechanical display showing elapsed time. The running time indicator operates only when an electrical generator, which is mechanically coupled with the engine, produces sufficient voltage to operate the indicator circuits. Sufficient voltage is produced at all engine speeds above a threshold speed which is less than engine idling speed. The generator supplies A.C. voltage to a doubler circuit that has two separate outputs-one for supplying large pulses of current for the stepping motor, and a partially isolated second output for other electronic loads. A tachometer output signal is provided at an auxiliary output terminal and is buffered to prevent disablement of the running time indicator by shirt circuits and externally applied voltages at the auxiliary output terminal. The running time indicator is therefore self-powered, relatively secure from tampering, and accurate.

U.S. Pat. No. 1,967,157 discloses a time measuring instrument of the kind in which a clockwork mechanism is adapted to integrate and indicate the total time of operation of an engine, machine, vehicle, aircraft, or the like. The device includes a motor spring, a flexible diaphragm, a spring winding device operatively connected to the time integrating mechanism, a main indicating hand, a loose auxiliary indicating hand mounted concentric with the main hand, a friction clutch for connecting both hands for movement as a unit, the diaphragm being operatively connected to the time integrating mechanism whereby movement of the diaphragm starts and stops the mechanism, the diaphragm being exposed to variable air pressure.

U.S. Pat. No. 1,785,724 discloses an elapsed time register for airplanes which records the length of time an airplane has been flown and the number of hours the motor has operated. The elapsed time register will also start and stop the airplane motor without having any mechanical connection therewith. The registering device includes a housing, a wind tunnel through the housing, an air screw in the tunnel, a guard at the mouth of the tunnel to prevent manipulation of the screw, a registering mechanism driven by the screw, and a device for limiting the rate of rotation of the screw.

SUMMARY OF THE INVENTION

In accordance with the present invention there is provided a compact and inexpensive meter for measuring and recording the time an engine driven apparatus has been running. The apparatus includes a signal generator such as a piezoelectric transducer which produces an electrical current when the engine driven apparatus is operating, a rectifier for converting the electrical current produced by said signal generator to direct current, a transistor for receiving the electrical current from the rectifier and switching on a stopwatch timing unit when the voltage received from the rectifier reaches a predetermined level.

The meter of the invention may be quickly and easily connected to an engine or engine driven equipment by adhesive tape to record the operating time of the engine or engine driven equipment. The meter may be easily removed from an engine or engine driven equipment by pulling the adhesive tape from the engine or engine driven equipment.

The stopwatch timing unit is activated or turned on by the vibration of the engine when the engine is operating, and will turn off when the engine turns off and vibration ceases. The timing unit can measure elapsed running time in tenths of an hour up to any desired total number of hours.

BRIEF DESCRIPTION OF THE DRAWINGS

The invention will be more fully understood by reference to the drawings in which.

DESCRIPTION OF THE PREFERRED EMBODIMENTS

Figure 1:
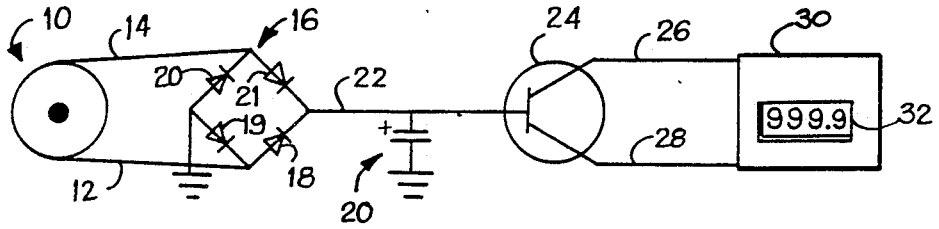
FIG. 1 is a schematic diagram of the electrical circuit of an embodiment of the invention.

Referring now to the drawings, in FIG. 1 is shown a schematic diagram of the electrical circuit of a preferred embodiment of the running time meter of the invention. A vibration sensor 10 produces an alternating current through electrical conductors 12 and 14 to the rectifier generally indicated by the numeral 16. Vibration sensor 10 is preferably a piezoelectric transducer which produces an alternating electric current when the piezoelectric material in the transducer is flexed by vibration.

Rectifier 16 preferably is formed from four diodes connected as shown in FIG. 1 to convert the alternating current produced by vibration sensor 10 to direct current. Direct current is supplied from rectifier 16 to fixed polarized capacitor 20 and switching transistor 24 through electrical conductor 22.

Fixed polarized capacitor polarized capacitor 20 serves two functions. First, fixed polarized capacitor 20 smooths the pulsating current from rectifier 16 into a steady direct current to keep switching transistor 24 switched on while an engine or engine driven equipment is being operated. Second, fixed polarized capacitor 20 prevents switching transistor from switching on due to any short term false vibrations which could occur in an engine or engine driven equipment caused by movement during transportation, or jarring of the engine or equipment when the engine is not being operated.

Capacitor 20 must be charged by the direct current produced by piezoelectric transducer 10 and rectifier 20. Once capacitor 20 reaches the trigger voltage of the transistor gate of switching transistor 24, transistor 24 will be switched on.

Transistor 24 is a switching transistor which is electrically connected to stopwatch 30 by electrical conductors 26 and 28. For stopwatch 30 to begin operating and recording elapsed time, the electrical conductors 26 and 28 must be electrically connected through switching transistor 24. Thus, once switching transistor 24 is turned on as explained above, stopwatch 30 begins recording elapsed running time.

Stopwatch 30 may be any conventional electrical stopwatch known in the art. Preferably stopwatch has the capability of accumulating elapsed running time during multiple stop and start cycles of the engine or engine driven equipment being monitored by the running time meter of the invention. Preferably stopwatch has a digital display 32 which indicates the elapsed running time of the engine or machine being monitored.

Figure 2:
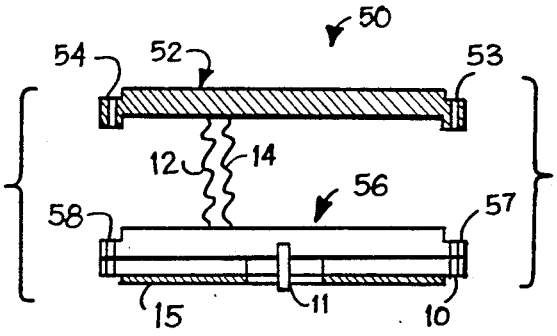
FIG. 2 is a cross-sectional side view of an embodiment of the invention.
Figure 3:
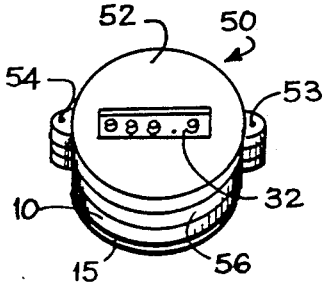
FIG. 3 is a perspective view of the top and side of the embodiment of the invention shown in FIG. 2.
Figure 4:
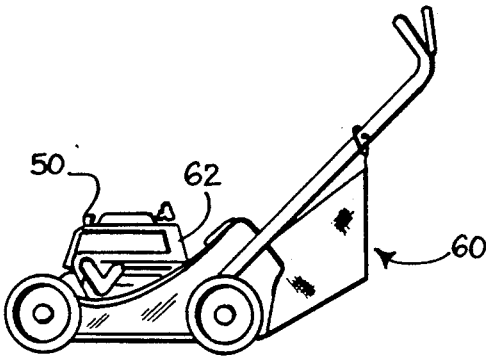
FIG. 4 is a side elevational view of a lawnmower having the meter of the invention attached hereto.

As can be seen in FIGS. 2 through 4, the running time meter of the invention is generally indicated by the numeral 50. As can be seen in FIG. 2, running time meter 50 is preferably constructed from two modules 52 and 56 which are electrically connected by electrically conductive wires 12 and 14.

Module 52 contains stopwatch 30. Module 52 permits stopwatch 30 to be located at a distance remote from vibration sensor 10. For example, vibration sensor 10 and/or module 56 could be connected to the engine of an engine driven machine, and module 52 could be connected to the operating handle or dash panel remote from the engine for easy viewing by the machine operator. Preferably, two holes 53 and 54 are located on the periphery of module 52 for receipt of a fastening device such as a pin, screw, bolt, wire, or the like.

Preferably, module 52 contains rectifier 16, capacitor 20, and switching transistor 24, in addition to stopwatch 30. Preferably, module 52 is formed from a water resistant and impact resistant material to protect the stopwatch 30, or combination of stopwatch 30, rectifier 16, capacitor 20, and switching transistor 24 therein from moisture and shock. Module 56 is preferably constructed from the same material as module 52. Exemplary of such materials are thermosetting and thermoplastic polymers such as polyvinyl chloride and the like. Furthermore, metals such as stainless steel and the like may be utilized to construct module 52 and module 56.

Connected to module 52 by wires 12 and 14 is module 56. Module 56 as shown in FIG. 2 has two holes 57 and 58 therein for receipt of a fastening device such as a screw, bolt, wire or the like for fastening module 56 to an engine or device to be monitored. Furthermore, holes 57 and 58 may be aligned with holes 53 and 54, and a fastener such as a screw or pin may be placed in each set of aligned holes to fasten module 52 to module 56. Module 52 is shown connected to module 56 in FIG. 3 to form a composite and compact running time meter 50. If it is desired to locate stopwatch 30 remotely from vibration sensor 10, all components of running time meter 50 may be enclosed in a single casing.

Module 56 has sensor 10 connected thereto which is preferably a piezoelectric transducer. Piezoelectric transducer 10 has a movable center post 11 connected thereto which is placed into contact with a vibrating object such as an internal combustion engine by attaching module 56 to the engine. Center post 11 vibrates upwardly and downwardly when placed in contact with a vibrating engine or machine to generate an electric current.

Preferably, module 56 has a flexible elastic pad 15 connected to the bottom thereof as shown in FIGS. 2 and 3. Flexible elastic pad 15 enables rigid module 56 to move slightly relative to the rigid surface to which rigid module 56 is attached. Movement of module 56 relative to the rigid surface to which it is attached, such as an engine, enhances the vibration of center post 11.

Pad 15 may be constructed of foamed rubber or plastic, or any conventional soft, spongy material such as soft rubber. Pad 15 may be attached to vibration sensor 10 by gluing, heat sealing, taping, or the like.

Module 56 and piezoelectric transducer 10 may be connected by any conventional means such as gluing, heat sealing, or the like. Module 56 may also contain rectifier 16, capacitor 20, and switching transistor 24 if desired.

In FIG. 4 is shown a conventional lawnmower generally indicated by the numeral 60. Running time meter 50 is shown connected to the engine 62 of lawnmower 60. Running time meter 50 could also be used with lawn tractors, riding mowers, outboard motors, jet ski's, watercraft, generators, tillers, pumps, diesel motors, small engines, pressure washers, air compressors, trenchers, snow blowers, all terrain vehicles, motorcycles, automobiles, electric motors, welding machines, blowers, stump grinders, log splitters, mortar mixers, compactors, sprayers, sweepers, turf rollers, sod cutters, augers, concrete saws, brush chipper, golf carts and the like.

Although the preferred embodiments of the present invention have been disclosed and described in detail above, it should be understood that the invention is in no sense limited thereby, and its scope is to be determined by that of the following claims:

What is claimed is:

1. A compact running time meter comprising, in combination:

a. electronic stopwatch means for recording the period of time said stopwatch is operating, b. vibration sensing means for producing an electrical current when vibration is occurring, and c. switching means for activating said electronic stopwatch means when said vibration sensor means is producing said electrical current.

2. The meter of claim 1 wherein said vibration sensing means is a piezoelectric transducer.

3. The meter of claim 1 wherein said vibration sensing means and said switching means are contained in first module means.

4. The meter of claim 3 wherein said first module means is electrically connected to said electronic stopwatch means.

5. The meter of claim 1 wherein said vibration sensing means is connectable to an object which vibrates.

6. The meter of claim 5 wherein said object which vibrates is an engine.

7. The meter of claim 6 wherein said engine is an internal combustion engine.

8. The meter of claim 5 wherein said object which vibrates is an engine driven machine.

9. The meter of claim 1 wherein said switching means comprises a transistor.

10. The meter of claim 9 wherein said transistor receives said electrical current produced by said vibration sensing means.

11. The meter of claim 10 wherein said electrical current produced by said vibration sensing means is alternating current.

12. The meter of claim 11 wherein said alternating current flows through rectifier means to convert said alternating current to direct current prior to said electrical current being received by said transistor means.

13. The meter of claim 13 wherein said rectifier means comprises diode means.

14. The meter of claim 12 wherein capacitor means is connected to said diode means between said diode means and said transistor to smooth pulsating voltage to said transistor.

15. The meter of claim 3 wherein said stopwatch is contained in second module means.

16. The meter of claim 15 wherein said first module means is connected to said second module means.

17. The meter of claim 1 wherein said vibration sensing means has flexible elastic pad means for permitting said vibration sensing means to move relative to a vibrating object to which said vibration sensing means is attached.

18. The meter of claim 3 wherein said vibration sensing means has flexible elastic pad means for permitting said vibration sensing means to move relative to a vibrating object to which said vibration sensing means is attached.

19. A compact running time meter comprising:

a. electronic stopwatch means for recording the period of time said stopwatch is operating, b. vibration sensing means for producing an electrical current when vibrations is occurring, and c. switching means for activating said electronic stopwatch means when said vibration sensor means is producing said electrical current, said electronic stop watch means, said vibration sensing means, and said switching means being connected together in a composite module connectable to an object which vibrates.

20. The meter of claim 20 wherein said vibration sensing means has flexible elastic pad means for permitting said composite module to move relative to a vibrating object to which said vibration sensing means is attached.

* * * * *